United States Patent [19]

Ishiguro et al.

[11] 4,397,943

[45] Aug. 9, 1983

[54] SILVER HALIDE PHOTOGRAPHIC LIGHT-SENSITIVE MATERIAL

[75] Inventors: Shoji Ishiguro, Minami-ashigara; Yoshiharu Fuseya, Odawara; Tatsuo Heki; Akio Mitsui, both of Minami-ashigara, all of Japan

[73] Assignee: Fuji Photo Film Co., Ltd., Kanagawa, Japan

[21] Appl. No.: 391,037

[22] Filed: Jun. 22, 1982

[30] Foreign Application Priority Data

Jun. 22, 1981 [JP] Japan ..... 56-96288

[51] Int. Cl.[3] ..... G03C 1/34

[52] U.S. Cl. ..... 430/609; 430/531; 430/545; 430/630; 430/961

[58] Field of Search ..... 430/609, 630, 377, 444, 430/531, 514, 537, 534, 545, 551, 627, 961, 213, 215, 217, 222, 230

[56] References Cited

U.S. PATENT DOCUMENTS

| | | | |
|---|---|---|---|
| 3,576,638 | 4/1971 | Tuites et al. | 430/609 |
| 3,598,599 | 10/1971 | Tuites et al. | 430/609 |
| 3,598,600 | 10/1971 | Tuites et al. | 430/609 |

*Primary Examiner*—Mary F. Downey

*Attorney, Agent, or Firm*—Sughrue, Mion, Zinn, Macpeak, and Seas

[57] ABSTRACT

A silver halide photographic light-sensitive material containing in at least one of its constituent layers a polymerized stabilizer which comprises repeating units having an 1,2,4-triazolo[1,5-a]pyrimidine moiety. The stabilizer does not inhibit the sensitivity of the material and greatly enhances its storability.

16 Claims, 1 Drawing Figure

SILVER HALIDE PHOTOGRAPHIC LIGHT-SENSITIVE MATERIAL

FIELD OF THE INVENTION

The present invention relates to a silver halide photographic light-sensitive material, and particularly to a silver halide photographic light-sensitive material containing a polimerized stabilizer.

BACKGROUND OF THE INVENTION 1,2,4-Triazolo[1,5-a]pyrimidines, e.g., 4-hydroxy-6-methyl-1,3,3a,7-tetraazaindene, have been prevailingly used as a stabilizer for silver halide photographic light-sensitive materials. However, such compounds have an undesirable aspect that they tend to diffuse and move among constituent layers of the silver halide photographic light-sensitive materials to which they are added, and tend also to undergo elution into processing solutions used because they are more weakly adsorbed by silver halides than mercapto compounds such as 1-phenyl-5-mercaptotetrazole and the like. Consequently, it is difficult to stabile a specified layer alone among constituent layers of the photographic light-sensitive material using a stabilizer of this kind, and an added stabilizer will diffuse more or less into other constituent layers to exert undesirable effects on photographic characteristics of the layer which comes to contain the stabilizer (for example, to reduce the sensitivity thereof). In addition, such stabilizers have the defect that when they are dissolved into certain processing solutions and accumulated therein, they make it difficult to control the developing speed of the photographic light-sensitive materials which are processed latter, because they contribute to retarding or accelerating the progress of development. Furthermore, when such a stabilizer is added in quantities to photographic light-sensitive materials to be spectrally sensitized with dyes, it reduces the spectral sensitivities thereof.

Therefore, it is clear that it would be desirable to have 1,2,4-triazolo[1,5-a]pyrimidine series stabilizers which have properties which prevent the above-described problems.

The above desire is attained in the present invention by converting a 1,2,4-triazolo[1,5-a]pyrimidines into polymers.

It has been attempted to convert compounds known as stabilizers for silver halide photographic light-sensitive materials into polymers of units of such compounds. For instance, U.S. Pat. Nos. 3,576,638, 3,598,599 and 3,598,600 disclose polymers containing repeatedly units of a tetrazole moiety, a thiazole moiety and an imidazole moiety, respectively. However, in each of such polymers, the above-described moiety is attached to the polymer chain through its characteristic functional group (e.g., mercapto group, etc.) that is believed to make the most important contribution to the stabilizing effect in a stabilizer having a low molecular weight. Therefore, the polymer as a whole has little stabilizing effect. In addition, U.S. Pat. No. 4,134,768 describes polymers having 1-phenyl-5-mercaptotetrazole attached to the polymer chains through groups other than a mercapto group. However, such polymers are added to interlayers in the diffusion transfer process and within these layers they do not act as stabilizers but as a silver ion scavengers.

However, at present there is no known way of converting 1,2,4-triazolo[1,5-a]pyrimidines, which are most prevailingly used as the stabilizer, into polymers thereof.

SUMMARY OF THE INVENTION

Therefore, a primary object of the present invention is to provide a novel polymerized stabilizer of units of an 1,2,4-triazolo[1,5-a]pyrimidine series compounds which stabilizes a specified layer alone among constituent layers of the photographic light-sensitive materials, is apt to control the developing speed of the photographic light-sensitive materials, inhibiting dissolution thereof into certain processing solutions and accumulation thereof, does not influence spectral sensitivity of the photographic light-sensitive materials, and has a good stabilizing effect.

Another object of the present invention is to provide a novel silver photographic light-sensitive material which is attended by the above-described advantages when a 1,2,4-triazolo[1,5-a]pyrimidine series stabilizer is added thereto.

The above-described objects are attained by a silver halide photographic light-sensitive material which contains in at least one of its constituent layers a polymer having repeatedly an 1,2,4-triazolo[1,5-a]pyrimidine moiety, preferably in such a state as to be represented by the following general formula (I):

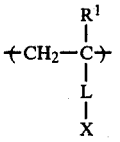

(I)

wherein $R^1$ represents hydrogen or a lower alkyl group; L represents a divalent bonding group; and X represents a monovalent 1,2,4-triazolo[1,5-a]pyrimidine moiety.

BRIEF DESCRIPTION OF THE DRAWING

The FIGURE graphically illustrates spectral sensitivity characteristics of green-sensitive layers of the light-sensitive sheets E and F, respectively, obtained in Example 6, wherein the solid line corresponds to the spectral sensitivity characteristic of the light-sensitive sheet E, and the dot-dash-line corresponds to that of the light-sensitive sheet F.

DETAILED DESCRIPTION OF THE INVENTION

Figure 1:
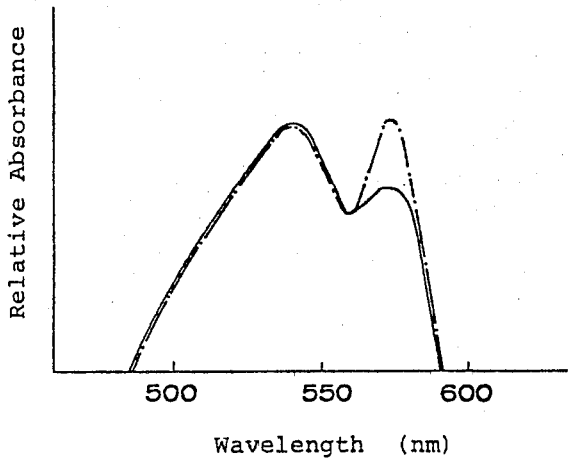

The general formula (I) is illustrated in greater detail below.

$R^1$ represents hydrogen or a lower alkyl group. Preferable examples of the lower alkyl group include those having up to 6 carbon atoms (e.g., methyl, ethyl, butyl, hexyl and so on). Among these groups, hydrogen and methyl group are particularly favorable as $R^1$.

L represents a divalent bonding group, preferably a group having 1 to 20 carbon atoms in total. Among such bonding groups, those represented by the following formulae (L-I) and (L-II) respectively are more advantageous.

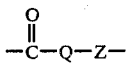

(L-I)

-continued (L-II)

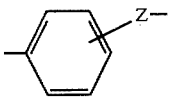

wherein Q represents —O— or

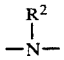

[wherein $R^2$ represents hydrogen or a lower alkyl group (which has preferably up to 6 carbon atoms)]; and Z represents an alkylene group (which has preferably up to 10 carbon atoms, and may include those having an amino bonding, an ester bonding and an ether bonding, respectively, between alkylene group, with specific examples including methylene group, ethylene group, propylene group, $—CH_2OCH_2—$, $—CH_2CONHCH_2—$, $—CH_2CH_2COOCH_2—$, $—CH_2CH_2OCOCH_2—$, $—CH_2NHCOCH_2—$ and so on), or an arylene group (which has preferably from 6 to 12 carbon atoms such as a p-phenylene group or so on). Specific examples of particularly preferable divalent bonding group represented by L include $—CONHCH_2—$, $—CONHCH_2CH_2—$, $—CONHCH_2OCOCH_2—$, $—CONHCH_2CH_2CH_2OCOCH_2—$, $—COOCH_2—$, $—COOCH_2CH_2—$, $—COOCH_2CH_2—$ $OCOCH_2—$, $—COOCH_2CH_2CH_2OCOCH_2—$ and

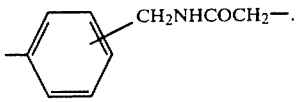

X represents a monovalent 1,2,4-triazolo[1,5-a]pyrimidine moiety. Preferable 1,2,4-triazolo[1,5-a]pyrimidines are those having 5 to 25 carbon atoms in total. Among such pyrimidine moieties, those having the following general formulae (X-I), (X-II), and (X-III), respectively, are more advantageous:

(X-I)

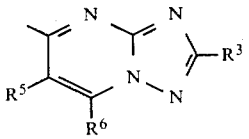

(X-II)

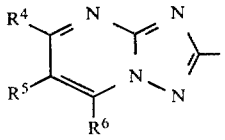

(X-III)

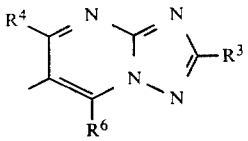

wherein $R^3$, $R^4$, $R^5$ and $R^6$ may be the same or different, and they each represents hydrogen, an unsubstituted or substituted alkyl group (preferably an alkyl group having up to 12 carbon atoms, e.g., methyl group, ethyl group, propyl group, hexyl group, hydroxyethyl group, carboxyethyl group, chloropropyl group, benzyl group, 2-(methoxycarbonyl)ethyl group, cyanopropyl group, trichloromethyl group, etc.), an unsubstituted or substituted aryl group (preferably an aryl group having 6 to 12 carbon atoms, e.g., phenyl group, naphthyl group, p-tollyl group, p-chlorophenyl group, o-carboxyphenyl group, etc.), a substituted amino group (e.g., dimethylamino group, acetylamino group, etc.), an unsubstituted or substituted carbamoyl group (e.g., carbamoyl group, methylcarbamoyl group, etc.), a hydroxy group, an —OM group (wherein M represents an alkali metal ion or an ammonium ion), a cyano group, a halogen atom (chlorine or bromine), an alkoxy group (e.g., methoxy group, ethoxy group, propoxy group, etc.), an alkoxycarbonyl group (e.g., methoxycarbonyl group, butoxycarbonyl group, etc.) and an alkylthio group (e.g., methylthio group, ethylthio group, butylthio group, etc.), or $R^4$ and $R^5$ may combine with each other and form a ring (e.g., cyclopentane ring, cyclohexane ring, cyclohexene ring, etc.). More preferable pyrimidine moieties are those having at least one hydroxy group or —OM group as $R^3$, $R^4$, $R^5$ or $R^6$ in the above-described formulae (X-I), (X-II) and (X-III), respectively. Specific examples of particularly preferable monovalent 1,2,4-triazolo[1,5-a]pyrimidine moieties are illustrated below.

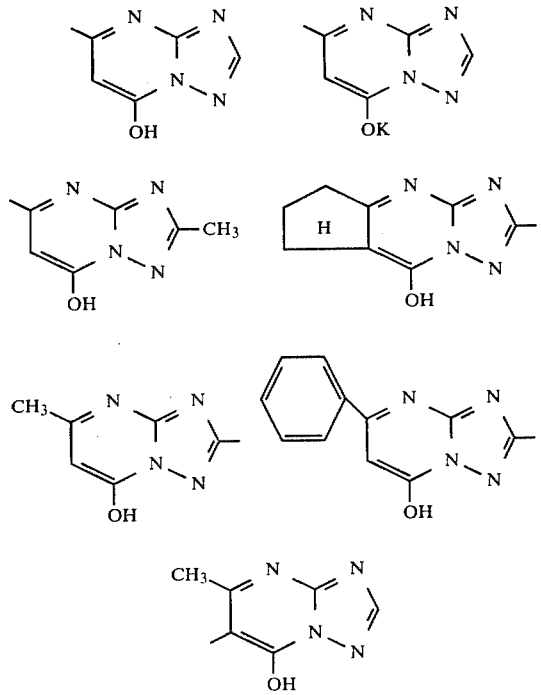

Polymers containing the repeating units represented by the general formula (I) of the present invention are generally obtained by polymerizing unsaturated monomers represented by the following general formula (II) independently, or by copolymerizing unsaturated monomers represented by the following general formula (II) and ethylenically unsaturated monomers copolymerizable with the above-described monomers:

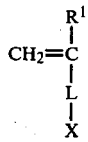

(II)

wherein $R^1$, L and X have the same meanings as in the general formula (I), respectively.

Specific examples of the monomer represented by the general formula (II) are illustrated below.

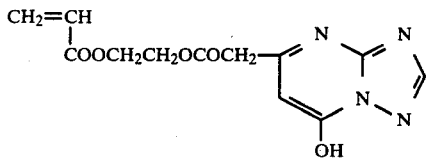

II-1

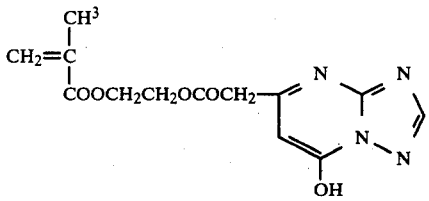

II-2

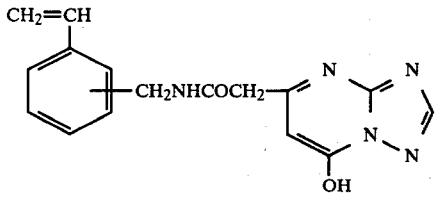

II-3

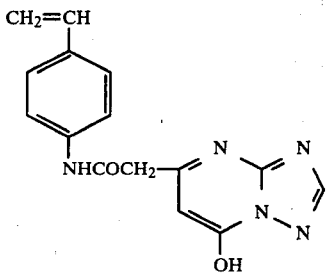

II-4

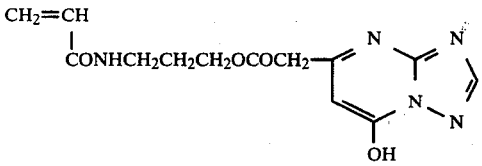

II-5

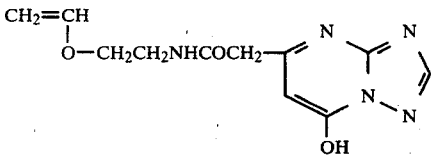

II-6

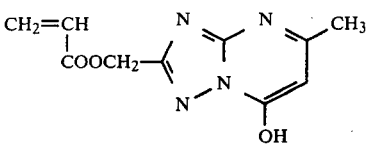

II-7

-continued

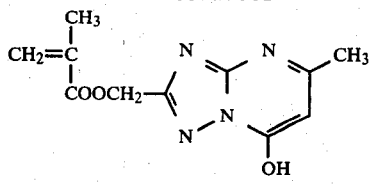

II-8

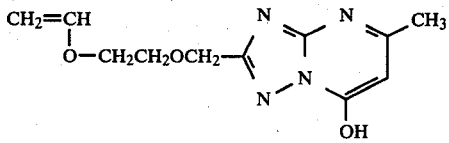

II-9

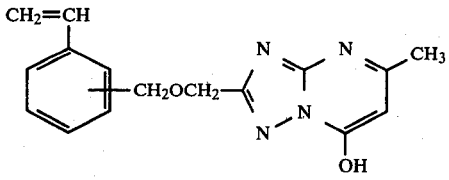

II-10

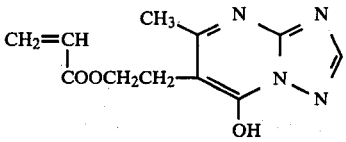

II-11

Among the above-described specific examples, monomers II-1, II-2, II-3, II-7, II-8 and II-11 are especially advantageous.

Such monomers as represented by the general formula (II) are generally synthesized by making 1,2,4-triazolo[1,5-a]pyrimidine derivatives having a side chain containing a carboxy group or a hydroxy group (e.g., those described in U.S. Pat. No. 2,835,581) and unsaturated monomers having an amino group, a hydroxy group or a carboxy group undergo condensation.

Some synthetic examples of the monomers represented by the general formula (II) are described in detail below. Monomers other than those illustrated in these synthetic examples can be also synthesized with ease according to these examples.

Synthesis Example 1: Synthesis of 5-acryloyloxyethoxycarbonylmethyl-7-hydroxy-1,2,4-triazolo[1,5-a]pyrimidine 19.4 g of 7-hydroxy-5-carboxymethyl-1,2,4-triazolo[1,5-a]pyrimidine and 12 g of hydroxyethylacrylate were dissolved in 150 ml of dimethylformamide (DMF) and thereto, a solution of 20.6 g of N,N-dicyclohexylcarbodiimide in 30 ml of DMF was added dropwise at a room temperature for 10 minutes. Thereafter, stirring was continued at a room temperature for 8 hours, and the precipitate produced was removed by filtration. The filtrate was condensed under a reduced pressure and low temperature. The thus obtained residue was chromatographed through silica gel put in a column in order to separate it into components and purify. The intended compound was obtained in a form of crystal. It was recrystallized from ethyl acetate. Thus, 6 g of white crystal having a melting point of 108° to 109° C. (intended compound) was obtained.

Synthesis Example 2: Synthesis of 5-{N-(vinylbenzyl)carbamoyl}methyl-7-hydroxy-1,2,4-triazolo[1,5-a]pyrimidine 54.8 g of 7-hydroxy-5-carboxymethyl-1,2,4-triazolo[1,5-a]pyrimidine and 37.6 g of vinylbenzylamine were dissolved in 700 ml of DMF and thereto, was added 58.2 g of N,N-dicyclohexylcarbodiimide at a room temperature. Thereafter, the stirring was continued at a room temperature for 8 hours. The precipitate produced was removed by filtration, and the filtrate was condensed under reduced pressure. To the thus obtained residue, 500 ml of methanol was added which resulted in the separation of crystals. They were filtered off, and dissolved in 400 ml of DMF as heat was applied thereto in order to maintain a temperature of 40° C. To the resulting solution, was added 2 liter of water in order to reprecipitate. The crystals thus precipitated were recovered by filtration. Thus, 50 g of white crystals having a melting point of 200° to 210° C. (decomposed) were obtained.

The polymers of the present invention may be homopolymers of the monomers represented by the general formula (II), or copolymers of the monomers of the general formula (II) and one or more of ethylenically unsaturated copolymerizable monomers.

Specific examples of ethylenically unsaturated monomers which can constitute preferable polymers of the present invention include ethylene, propylene, 1-butene, isobutene, styrene, chloromethylstyrene, hydroxymethylstyrene, potassium vinylbenzenesulfonate, sodium vinylbenzenesulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzylvinylpyridinium chloride, N-vinylacetoamide, N-vinylpyrrolidone, 2-methyl-3-methylimidazole, monoethylenically unsaturated esters of aliphatic acids (e.g., vinyl acetate, allyl acetate, etc.), ethylenically unsaturated monocarboxylic acids of dicarboxylic acids (e.g., acrylic acid, methacrylic acid, itaconic acid, maleic acid, etc.), maleic anhydride, ethylenically unsaturated esters of monocarboxylic acids or dicarboxylic acids (e.g., n-butylacrylate, n-hexylacrylate, hydroxylethylacrylate, cyanoethylacrylate, N,N-diethylaminoethylacrylate, methylmethacrylate, n-butylmethacrylate, benzylmethacrylate, hydroxyethylmethacrylate, chloroethylmethacrylate, methoxyethylmethacrylate, N,N-diethylaminoethylmethacrylate, N,N,N-triethyl-N-methacryloyloxyethylammonium p-toluenesulfonate, N,N-diethyl-N-methyl-N-methacryloyloxyethylammonium p-toluenesulfonate, dimethyl itaconate, monobenzylmaleate, etc.), amides of ethylenically unsaturated monocarboxylic acids or dicarboxylic acids (e.g., acrylamide, N,N-dimethyl-N'-methacryloylpropanediamineacetate betaine, N,N-dimethyl-n'-acryloylpropanediaminepropionate betaine, N,N-dimethylacrylamide, N-methylolacrylamide, N-(N,N-dimethylaminopropyl)acrylamide, N,N,N-trimethyl-N-(N-acryloylpropyl)ammonium p-toluenesulfonate, sodium 2-acrylamido-2-methylpropanesulfonate, acryloylmorpholine, sodium 2-acrylamido-2-methylpropanesulfonate, methacrylamide, etc.) and so on.

Among these ethylenically unsaturated monomers, salts of vinylbenzenesulfonic acids, salts of vinylbenzenesulfinic acids, monoethylenically unsaturated esters of aliphatic acids and saponified products thereof, sodium 2-acrylamido-2-methylpropanesulfonate, N-vinylpyrrolidone, esters of ethylenically unsaturated monocarboxylic acids (e.g., hydroxyethylacrylate and hydroxyethylmethacrylate), amides of ethylenically unsaturated monocarboxylic acids (e.g., acrylamide and methacrylamide) and the like are more advantageous.

The polymerization degree of the polymers of the present invention may be arbitrarily chosen. However, the polymers can provide good results when they have molecular weights of $5\times10^3$ to $3\times10^6$, more particularly $10^4$ to $10^6$.

When the copolymers of the monomers with the ethylenically unsaturated monomers are used, their copolymerization ratio may be arbitrarily chosen. However, the effect of the present invention can be obtained when the copolymer contains the repeating units represented by the general formula (I) in a fraction of at least 0.1 mole % or more, particularly 1 mole % or more.

Specific examples of the polymers of the present invention are illustrated below.

1. 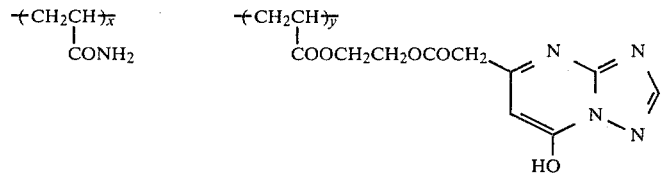

| | 1-1 | 1-2 | 1-3 |
|---|---|---|---|
| x | 95 | 90 | 0 |
| y | 5 | 10 | 100 |

2. 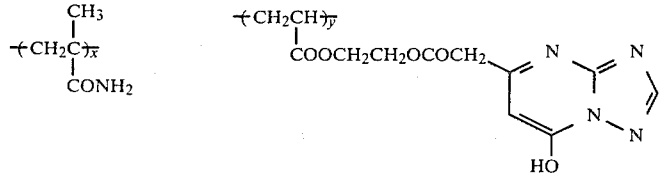

| | 2-1 | 2-2 |
|---|---|---|
| x | 95 | 90 |
| y | 5 | 100 |

3. 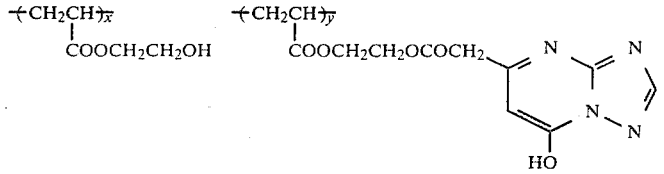

| | 3-1 | 3-2 |
|---|---|---|
| x | 95 | 90 |
| y | 5 | 10 |

-continued
4.
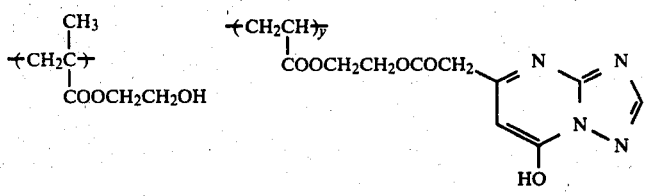
| | 4-1 | 4-2 |
|---|---|---|
| x | 95 | 90 |
| y | 5 | 10 |
5.
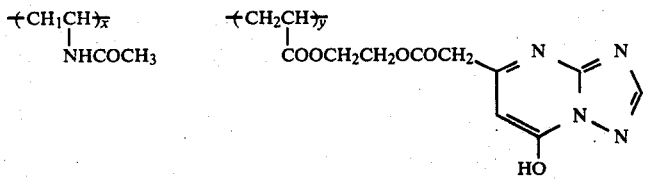
| | 5-1 | 5-2 |
|---|---|---|
| x | 95 | 90 |
| y | 5 | 10 |
6.
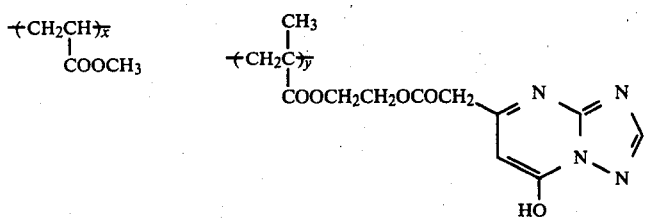
| | 6-1 | 6-2 |
|---|---|---|
| x | 90 | 0 |
| y | 10 | 100 |
7.
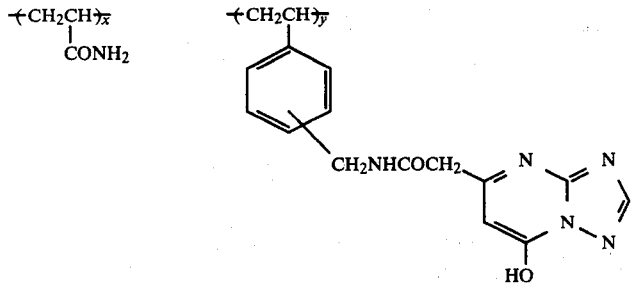
| | 7-1 | 7-2 | 7-3 |
|---|---|---|---|
| x | 95 | 90 | |
| y | 5 | 10 | 100 |
8.
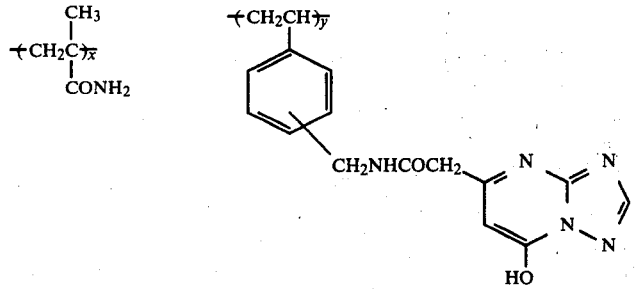
| | 8-1 | 8-2 |
|---|---|---|
| x | 95 | 90 |
| y | 5 | 10 |
9.
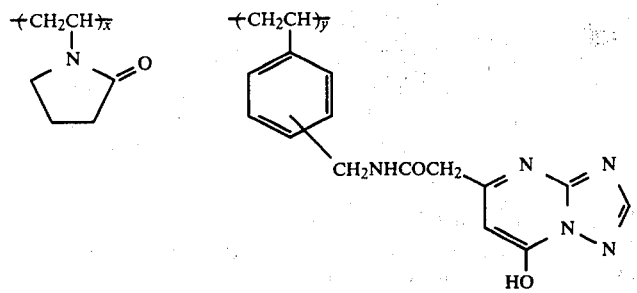
| | 9-1 | 9-2 | 9-3 | 9-4 | 9-5 |
|---|---|---|---|---|---|
| x | 77 | 58 | 32 | 19 | 7 |
| y | 23 | 42 | 68 | 81 | 93 |

-continued

10. 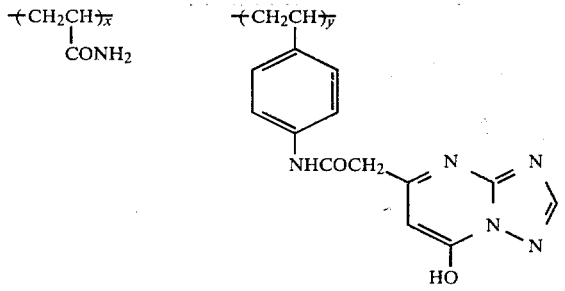

| | 10-1 | 10-2 |
|---|---|---|
| x | 90 | 0 |
| y | 10 | 100 |

11. 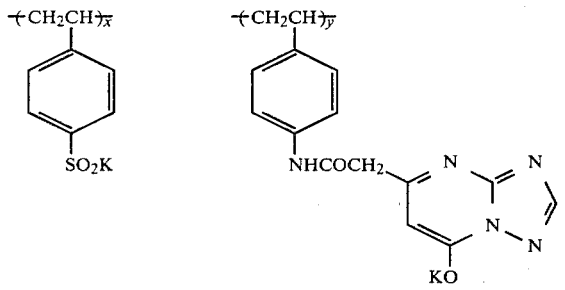

| | 11-1 | 11-2 |
|---|---|---|
| x | 90 | 80 |
| y | 10 | 20 |

12. 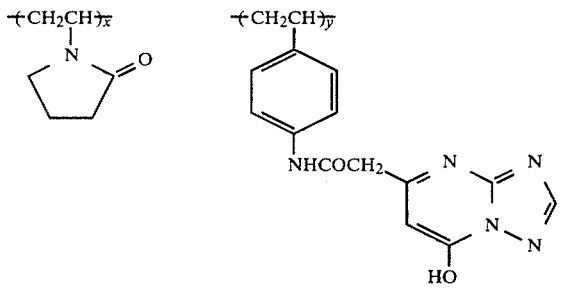

| | 12-1 | 12-2 |
|---|---|---|
| x | 75 | 52 |
| y | 25 | 48 |

Among the specific examples as described above, most preferred examples of the polymers of the present invention involves 1-1, 1-2, 1-3, 2-1, 7-2, 8-2, 9-1, 9-4 and 9-5.

Homopolymerization of the monomers represented by the general formula (II) and copolymerization of the monomers of the general formula (II) with other ethylenically unsaturated monomers can be carried out according to, for example, the synthesis process described in Ronald L. Schnaar, Yuan Chuan Lee, et al., *Biochemistry, p.* 1535 (1976); the synthesis process described in Anthony Winston, Glenn R. Mclaughlin, et al., *Journal of Polymer Science: Polymer Chemistry Edition,* p. 2155 (1976); the synthesis process described in Hans-Georg Batz, Johanna Koldehorf, et al., *Die Makromolekule Chemie,* Vol. 177, p. 683 (1976); the synthesis process described in Hans-Georg Batz, Giselner Franzmann, Helmut Ringsdorf, et al., *Angewante Chemie; Internat. Edition,* p. 1103 (1972); and the synthesis process described in P. Ferruti, A. Bettelli, Angelino Fere, et al., Polymer, p. 462 (1972).

Typical synthesis examples of the polymers of the present invention are illustrated in detail below.

Synthesis Example 3: Synthesis of poly[acrylamido-co-5-acryloyloxyethoxycarbonylmethyl-7-hydroxy-1,2,4-triazolo[1,5-a]pyrimidine]

In the reaction vessel, were placed 43.3 g of acrylamide, 9.4 g of 5-aryloyloxyethoxycarbonylmethyl-7-hydroxy-1,2,4-triazolo[1,5-a]pyrimidine and 470 ml of tetrahydrofuran (THF). The mixture was heated to 60° C. with stirring and thereto, was added 1.5 g of 2,2'-azobis-2,4-dimethylvaleronitrile (polymerization initiator, trade name V-65, produced by Wako Junyaku Kogyo Co., Ltd.) and the stirring was continued at a temperature of 60° C. for 2 hours. Thereafter, the reaction mixture was allowed to stand at a room temperature to result in formation of a precipitate. The precipitate deposited was filtered off and dried. Thus, 52 g of white polymer (intended polymer) was obtained.

Synthesis Example 4: Synthesis of poly[N-vinylpyrrolidone-co-5-{N-(vinylbenzyl)carbamoyl}methyl-7-hydroxy-1,2,4-triazolo[1,5-a]pyrimidine]

2.2 g of N-vinylpyrrolidone, 9.3 g of 5-{N-(Vinylbenzyl)carbamoyl}methyl-7-hydroxy-1,2,4-triazolo[1,5-a]pyrimidine and 25 g of DMF were placed in the reaction vessel, and heated to 79° C. with stirring. Thereto, 0.13 g of V-65 (commercially produced polymerization initiator) was added, and the stirring was continued at 80° C. for 2 hours. Thereafter, the reaction mixture was allowed to stand till the temperature thereof was cooled to room temperature. The reaction mixture was added to 1 liter of acetone. The precipitate produced was filtered off and dried. Thus, 9.3 g of white polymer (intended polymer) was obtained.

Other polymers can be synthesized with ease according to the above-described synthesis examples.

The polymer of the present invention is added to at least one constituent layer of a photographic light-sensitive material. The most preferable constituent layers to which the polymer of the present invention is to be added are silver halide emulsion layers. There is no restriction as to the addition time. That is, the polymer may be added at any stage of the emulsion-making, emulsion-coating or other processes depending on the end-use purpose thereof. Examples of layers, other than silver halide emulsion layers, to which the polymers of the present invention can be added include various assistant layers such as a protective layer, a subbing layer, an interlayer, a filter layer and so on.

The polymer of the present invention may be employed independently as the only stabilizer, or may be employed in combination with other known stabilizers. For instance, the combined use of 1,2,4-triazolo[1,5-a]pyrimidines, especially 4-hydroxy-6-methyl-1,3,3a,7-tetraazaindene, and the polymer of the present invention is advantageous because both the stabilizers have, in principle, the same mechanism for stabilizing silver halides and therefore, strong stabilization can be attained without any harmful side-effects, and further because problems which have so far been caused when a large quantity of 1,2,4-triazolo[1,5-a]pyrimidines have been required for stabilization, i.e., reduction of spectral sensitivity, stain due to elution and accumulation thereof in a processing solution and so on, can be solved without lowering the stabilization effect.

Therefore, any particular restriction is not placed on the addition amount of the polymer of the present invention, and the addition amount can vary over a wide range. As a suggested amount to be used, it is said that the polymer can be added in an amount of $10^{-8}$ to $10^{-3}$ mole, particularly $10^{-7}$ to $5\times10^{-4}$ mole, per 1 $m^2$ of support, converted to a mole number basis of the 1,2,4-triazolo[1,5-a]pyrimidine moiety contained in the polymer. The above-described range corresponds to about 0.02 mg to about 2 g, particularly about 0.2 mg to about 1 g, per 1 $m^2$ of support, and about 60 mg to about 200 g, particularly about 300 mg to about 100 g, per 1 mole of silver halide, calculated on the weight basis of the polymer.

Suitable examples of stabilizers, other than the above-described 1,2,4-triazolo[1,5-a]pyrimidines, which can be used in combination with the polymers of the present invention include azoles such as benzothiazolium salts, nitroindazoles, triazoles, benzotriazoles, benzimidazoles (especially nitro or halogen substituted products thereof) and so on; heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines and so on; the above-described heterocyclic mercapto compounds having water soluble groups such as carboxyl group or sulfo group; thioketone compounds such as oxazolinethione and so on; benzenethiosulfonic acids; benzenesulfinic acids; and other various compounds known as a stabilizer or an antifoggant.

Suitable examples of silver halide which can be employed in the photographic emulsion layer of the photographic light-sensitive material of the present invention include silver bromide, silver iodobromide, silver iodochlorobromide, silver chlorobromide, and silver chloride. The selection of a particular grain size of silver halide grains contained in the photographic emulsion is somewhat unimportant. (The mean grain size is expressed in terms of the average of grain diameters determined based on projection areas when grains are spherical or nearly spherical in shape. On the other hand, when grains are cubic in shape, it is expressed in terms of the average of edge lengths determined based on projection areas.) However, it is preferable to have a grain size of 3μ or smaller. The grain size distribution of the silver halide grains (narrow or wide) is also somewhat unimportant.

Silver halide grains in the photographic emulsion may have a regular form like cube or octahedron, or an irregular form like a sphere, plate or so on, or a complex form thereof. Further, the silver halide grains may be composed of those having different crystal forms respectively.

The silver halide grain may be comprised of a core and an outer layer which differ in phase from each other, or may have a uniform phase as a whole. In addition, the silver halide grain may be a grain of the kind of which forms a latent image at its surface to a very appreciable extent, or a grain of the kind which forms a latent image inside thereof and substantially no latent image on its surface.

Photographic emulsions to be employed in the present invention can be prepared using the processes described in P. Glafkides, *Chimie et Physique Photographique,* Paul Montel, Paris (1967), G. F. Diffin, *Photographic Emulsion Chemistry,* The Focal Press (1966), V. L. Zelikman, et al., *Making and Coating Photographic Emulsion,* The Focal Press (1964), and so on. That is, it is possible to use any process such as an acid process, a neutral process, or an ammonia process. The reaction of water soluble salts with water soluble halides may be carried out using a single jet method, a double jet method, or a combination of these methods.

A method of producing grains under condition of excess silver ion (a so-called reverse jet method) can be also employed. In addition, a method corresponding to one embodiment of the double jet method, wherein the pAg of the liquid phase in which silver halide are produced is maintained constant, that is, a so-called controlled double jet method can be also employed.

According to the controlled double jet method, silver halide emulsions which contain grains having a regular crystal form and a nearly equal size can be obtained.

Two or more of silver halide emulsions produced separately may be employed in the form of a mixture.

When producing or physically ripening silver halide grains, a cadmium salt, a zinc salt, a lead salt, a thallium salt, an iridium salt or its complex salt, a rhodium salt or its complex salt, an iron salt or its complex salt, and the like may be present.

Both negative type emulsions and direct reversal type emulsions can be employed in the present invention. The latter emulsions include emulsions having high internal sensitivity, but low surface sensitivity, and previously fogged direct reversal type emulsions.

Examples of emulsions having high internal sensitivity, but low surface sensitivity which can be advantageously employed in the present invention include conversion type emulsion, core/shell type emulsions and emulsions in which different metals are incorporated, as described in U.S. Pat. Nos. 2,592,250, 3,206,313, 3,447,927, 3,761,276 and 3,935,014 and so on.

Typical examples of nucleating agents for the emulsions of the above-described types include hydrazines described in U.S. Pat. Nos. 2,588,982 and 2,563,785; hydrazides and hydrazones described in U.S. Pat. No. 3,227,552; quaternary salt compounds described in British Pat. No. 1,283,835; published examined Japanese Patent Application No. 38164/74; and U.S. Pat. Nos. 3,734,738, 3,719,494 and 3,615,615; sensitizing dyes having nucleating substituents in their individual dye molecules described in U.S. Pat. No. 3,718,470; and acylhydrazinophenylthiourea series compounds described in U.S. Pat. Nos. 4,030,925 and 4,031,127.

A number of different hydrophilic binding agents or protective colloids can be employed in the photographic emulsions, but gelatin is advantageously employed.

For example, proteins such as gelatin derivatives, graft polymers prepared from gelatin and other polymers, albumine, casein or so on; sugar derivatives such as hydroxyethylcellulose, carboxymethylcellulose, cellulose sulfates, sodium alginate, starch derivatives and so on; and various kinds of synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole and so on can be employed as the binding agent.

It is possible to use not only lime processed gelatin but also acid processed gelatin and enzyme processed gelatins as described in *Bull. Soc. Sci. Phot. Japan,* No. 16, p. 30 (1966). In addition, hydrolysis products and enzymatically decomposed products of gelatin can also be employed. Gelatin derivatives include reaction products of gelatin with various kinds of compounds such as acid halides, acid anhydrides, isocyanates, bromoacetic acid, alkane sultones, vinylsulfonamides, maleinimide compounds, polyalkylene oxides, epoxy compounds and so on. Specific examples of such gelatin derivatives are described in U.S. Pat. Nos. 2,614,928, 3,132,945, 3,186,846 and 3,312,553; British Pat. Nos. 861,414, 1,033,189 and 1,005,784; published examined Japanese Patent Application No. 26845/67; and so on.

Suitable examples of the above-described gelatin graft polymers which can be used in the present invention include those obtained by grafting on gelatins homopolymers or copolymers of vinyl monomers such as acrylic acid, methacrylic acid, derivatives thereof (e.g., their esters and their amides), acrylonitrile, styrene and so on. In particular, graft polymers constituted with gelatins and polymers having some measure of compatibility with gelatin, for example, polyacrylic acid, polymethacrylic acid, polyacrylamide, polymethacrylamide, polyhydroxyalkylmethacrylate and the like, are used to advantage. Specific examples of these graft polymers are described in U.S. Pat. Nos. 2,763,625, 2,831,767 and 2,956,884, and so on.

Typical examples of synthetic hydrophilic polymers which can be used in the present invention include those described in German Patent Application (OLS) No. 2,312,708; U.S. Pat. Nos. 3,620,751 and 3,879,205; and published examined Japanese Patent Application No. 7561/68.

The surface and/or the interior of grains in the silver halide emulsions to be employed in the present invention may be chemically sensitized. The chemical sensitization can be carried out using processes described in, e.g., H. Frieser, *Die Grundlagen der Photographischen Prozesse mit Silberhalogeniden,* pp. 675 to 734, Akademische Verlagsgesellschaft (1968).

That is, sulfur sensitization processes using compounds containing sulfur reactive with active gelatins and silver ions (e.g., thiosulfates, thioureas, mercapto compounds and rhodanines), reduction sensitization processes using reductive compounds (e.g., stannous salts, amines, hydrazine derivatives, formamidinesulfinic acid and silane compound), noble metal sensitization processes using noble metal compounds (e.g., gold complexes, and complexes of Group VIII metals such as Pt, Ir, Pd and so on) and so on can be used individually or in combination thereof.

Specific examples of these chemical sensitization processes include those of sulfur sensitization processes described in U.S. Pat. Nos. 1,574,944, 2,410,689, 2,278,947, 2,728,668 and 3,656,955; those of reduction sensitization processes described in U.S. Pat. Nos. 2,983,609, 2,419,974 and 4,054,458; and those of noble metal sensitization processes described in U.S. Pat. Nos. 2,399,083 and 2,448,060; and British Pat. No. 618,061.

Surface chemical sensitization of the silver halide grains of the kind which form latent image predominantly inside thereof can be carried out by the process described in published examined Japanese Patent Application No. 34213/77. When the above-described kind of silver halide grains are comprised of a core and a shell, the surface chemical sensitization technique described in Japanese Patent Application No. 22681/81, in which the surface chemical sensitization is carried out in the presence of specified polymers, can be utilized.

Photographic emulsions which can be employed in the present invention may be spectrally sensitized with methine dyes or others. Useful examples of sensitizing dyes which can be used include those described in, e.g., German Pat. No. 929,080; U.S. Pat. Nos. 2,493,748, 2,503,776, 2,519,001, 2,912,329, 3,656,959, 3,672,897, 3,694,217, 4,025,349 and 4,046,527; British Pat. No. 1,242,588; and published examined Japanese Patent Application Nos. 14030/69 and 24844/77. These sensitizing dyes may be employed individually or in combination thereof. Combinations of sensitizing dyes have often been employed for the particular purpose of supersensitization. Typical examples of the supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862 and 4,026,707; British Pat. Nos. 1,344,281 and 1,507,803; published examined Japanese Patent Application Nos. 4936/68 and 12375/78; published unexamined Japanese Patent Application Nos. 110618/77 and 109925/77; and so on.

Substances which can exhibit supersensitizing effects when used in combination with sensitizing dyes, though they are dyes which themselves do not have the spectral sensitizing effect or substances which do not substantially absorb visible light, may be incorporated in the photographic emulsion. For example, aminostilbene compounds substituted with nitrogen-containing heterocyclic moieties (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds and so on may be incorporated. The combinations described in U.S. Pat. Nos. 3,615,613, 3,615,641, 3,617,295 and 3,635,721 are particularly useful for supersensitization.

In the photographic light-sensitive materials of the present invention, their photographic emulsion layers and other hydrophilic colloidal layers may contain inorganic or organic hardening agents. Suitable examples of the hardening agent which can be used in the present invention include chromium salts (e.g., chrome alumn, chromium acetate, etc.), aldehydes (e.g., formaldehyde, glyoxal, glutaraldehyde, etc.), N-methylol compounds (e.g., dimethylol urea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.) and so on. These hardening agents may be used individually or in combination thereof. Specific examples of the above-described hardening agents and other hardening agents which can be used in the present invention are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827 and 3,543,292; British Pat. Nos. 676,628, 825,544 and 1,270,578; German Pat. Nos. 872,153 and 1,090,472; published examined Japanese Patent Application Nos. 7133/58 and 1872/71; *Research Disclosure,* Vol. 176, p. 26 (Dec. 1978); and so on.

In the photographic emulsion layers or other hydrophilic colloidal layers of the light-sensitive materials of the present invention, a wide variety of surface active agents may be incorporated for various purposes, for example, as a coating aid, prevention from the generation of static charges, improvement in the slipping ability, emulsifying dispersion, prevention from occurrence of adhesion, improvement in the photographic characteristics (e.g., development acceleration, rendering tone high contrast, sensitization, etc.) and so on.

Specific examples of surface active agents which can be used in the present invention include nonionic surface active agents such as saponin (steroid system), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitane esters, polyalkylene glycol alkyl amines or amides, and polyethylene oxide adducts of silicone), glycidol derivatives (e.g., alkenylsuccinic acid polyglycerides, and alkylphenol polyglycerides), fatty acid esters of polyhydric alcohols, alkyl esters of sugar, and so on; anionic surface active agents which contain acid groups, e.g., carboxyl group, sulfo group, sulfate group, phosphate group or so on, such as alkyl carboxylates, alkyl sulfonates, alkylbenzene sulfonates, alkylnaphthalene sulfonates, alkyl sulfates, alkyl phosphates, N-acyl-N-alkyltaurines, sulfosuccinates, sulfoalkylpolyoxyethylene alkylphenyl ethers, polyoxyethylene alkylphosphates and so on; amphoteric surface active agents such as amino acids, aminoalkyl sulfonates, aminoalkyl sulfates or phosphates, alkylbetaines, amine oxides, and so on; and cationic surface active agents such as alkylamine salts, aliphatic or aromatic quaternary ammonium salts, quaternary ammonium salts of hetero rings such as pyridinium, imidazolium and the like, aliphatic or heterocyclic ring-containing phosphonium or sulfonium salts, and so on.

In photographic emulsion layers and other hydrophilic colloidal layers of the photographic light-sensitive materials of the present invention, dispersions of water insoluble or slightly soluble synthetic polymers can be incorporated for the purposes of improving dimentional stability, and so on. Examples of such synthetic polymers include homopolymers of such monomers as alkyl(metha)acrylate, alkoxyalkyl(metha)acrylate, glycidyl(metha)acrylate, (metha)acrylamide, vinyl esters (e.g., vinyl acetate), acrylonitrile, olefins, styrene and so on; copolymers of two or more kinds of monomers selected from the above-described monomers; and copolymers containing as monomer components combinations of monomers selected from the above-described monomers with monomers selected from the group consisting of acrylic acid, methacylic acid, $\alpha,\beta$-unsaturated dicarboxylic acids, hydroxyalkyl(metha)acrylates, sulfoalkyl(metha)acrylates, styrenesulfonic acid and so on. Specific examples of these polymers include those described in, e.g., U.S. Pat. Nos. 2,376,005, 2,739,137, 2,853,457, 3,062,674, 3,411,911, 3,488,708, 3,525,620, 3,607,290, 3,635,715 and 3,645,740; and British Pat. Nos. 1,186,699 and 1,307,373.

In order to increase sensitivity, contrast, or accelerate development, photographic emulsions of the photographic light-sensitive materials of the present invention may contain polyalkylene oxides or derivatives thereof, such as their ethers, their esters, their amines and so on, thioether compounds, thiomorpholines, quaternary ammonium salt compounds, urethane derivatives, urea derivatives, imidazole derivatives, 3-pyrazolidones and so on. For example, those described in U.S. Pat. Nos. 2,400,532, 2,423,549, 2,716,062, 3,617,280, 3,772,021 and 3,808,003; British Pat. No. 1,488,991; and so on can be specifically employed for the above-described purposes.

In addition to the above-described additives, the photographic light-sensitive materials of the present invention can contain photographic dyes, an ultraviolet absorbing agent, a brightening agent, a slippability improving agent, a matting agent and so on. Specific examples of these additives are described in detail in *Research Disclosure,* Vol. 176, pp. 22 to 31.

The photographic light-sensitive materials of the present invention can be used as black-and-white photographic light-sensitive materials and also, as color photographic light-sensitive materials. In order to use the photographic light-sensitive materials of the present invention as color photographic materials, it is necessary to employ various kinds of dye image providing compounds therein. These dye image providing compounds may include both compounds to be used in the conventional color photography and compounds to be used in the color photography based on the diffusion transfer process.

A dye image providing compound which is employed in the conventional color photography is a color forming coupler, that is, a compound which can form color by oxidative coupling with an aromatic primary amine developing agent (e.g., phenylenediamine derivatives, aminophenol derivatives and the like) upon color development processing. Examples of magenta couplers include 5-pyrazolone couplers, pyrazolobenzimidazole couplers, cyanoacetylcumarone couplers, open-chain acylacetonitrile couplers, and so on. Examples of yellow couplers include acylacetoamide couplers (e.g., benzoylacetoanilides and pivaloylacetoanilides) and so on, and those of cyan couplers include naphthol couplers, phenol couplers and the like. It is preferred to render these couplers nondiffusible by introduction of hydrophobic groups called ballast groups into their individual molecules. Such a coupler may be four equivalent or two equivalent with respect to silver ion. Further, such a coupler may be a colored coupler having a color correcting effect, or may be a coupler capable of releasing a development inhibitor with the progress of development (a so-called DIR coupler). Furthermore, such a coupler may be a colorless DIR coupling compound which is converted to a colorless compound upon the coupling reaction and that, releases a development inhibitor.

In the photographic materials of the present invention, a color fog preventing agent, such as a hydroquinone derivative, an aminophenol derivative, a gallic acid derivative, an ascorbic acid derivative or so on, may be incorporated together with color forming couplers as described above. Specific examples of the color fog preventing agent are described in U.S. Pat. Nos. 2,360,290, 2,336,327, 2,403,721, 2,418,613, 2,675,314, 2,701,197, 2,704,713, 2,728,659, 2,732,300 and 2,735,365; published unexamined Japanese Patent Application Nos. 92988/75, 92989/75, 93928/75, 110337/75 and 146235/77; published examined Japanese Patent Application No. 23813/75; and so on.

In addition, known discoloration inhibitors can also be employed in the present invention individually or as a combination of two or more thereof. Suitable examples of known discoloration inhibitors include hydroquinone derivatives, gallic acid derivatives, p-alkoxyphenols, p-oxyphenol derivatives and bisphenols.

Specific examples of the hydroquinone derivatives are described in U.S. Pat. Nos. 2,360,290, 2,418,613, 2,675,314, 2,701,197, 2,704,713, 2,728,659, 2,732,300, 2,735,765, 2,710,801 and 2,816,028; British Pat. No. 1,363,921; and so on. Specific examples of the gallic acid derivatives are described in U.S. Pat. Nos. 3,457,079 and 3,069,262, and so on. Specific examples of the p-alkoxyphenols are described in U.S. Pat. Nos. 2,735,765 and 3,698,909; and published examined Japanese Patent Application Nos. 20977/74 and 6623/77. Specific examples of the p-oxyphenol derivatives are described in U.S. Pat. Nos. 3,432,300, 3,573,050, 3,574,627 and 3,764,337; and published unexamined Japanese Patent Application Nos. 35633/77, 147434/77 and 152225/77. And, those of the bisphenols are described in U.S. Pat. No. 3,700,455.

Various kinds of compounds can be used as dye image providing compounds to be employed in the present invention when the color photography based on the diffusion transfer process is applied thereto. In particular, couplers and dye releasing redox compounds are used to great advantage.

Examples of dye releasing redox compounds of the kind which, when oxidized, release dyes through hydrolysis under an alkaline condition include those described in U.S. Pat. Nos. 4,053,312, 4,055,428, 4,076,529, 4,152,153 and 4,135,929; published unexamined Japanese Patent Application Nos. 149328/78, 104343/76, 46730/78, 130122/79, 3819/78, 12642/81, 16130/81 and 15392/81, and so on.

Specific examples of the yellow dye releasing redox compounds of the above-described kind are described in U.S. Pat. No. 4,013,633; published unexamined Japanese Patent Application Nos. 149328/78, 114930/76 and 71072/81; *Research Disclosure,* 17630 (1978) and 16475 (1977); and so on.

Specific examples of the magenta dye releasing redox compounds of the above-described kind are described in U.S. Pat. Nos. 3,854,476, 3,931,144 and 3,932,308; published unexamined Japanese Patent Application Nos. 23628/78, 106727/77, 65034/79, 161332/79, 4028/80, 36804/80, 73057/81, 71060/81 and 134850/80; German Patent Application (OLS) No. 2,847371; and so on.

Specific examples of the cyan dye releasing redox compounds of the above-described kind are described in U.S. Pat. Nos. 3,942,987, 3,929,760 and 4,013,635; published unexamined Japanese Patent Application Nos. 109928/76, 149328/78, 8827/77, 143323/78, 47823/78 and 71061/81; and so on.

Examples of dye releasing redox compounds of the kind which release dyes through ring closure of the nonoxidized part thereof include those described in U.S. Pat. Nos. 4,139,379 and 3,980,479; German Patent Application (OLS) Nos. 2,402,900 and 2,448,811; and so on.

On the other hand, couplers which can be used in the color photography based on the diffusion transfer process are described in, for example, T. H. James, *The Theory of Photographic Process,* The 4th Ed., Chapter 12 (1977).

The above-described dye image providing compounds can be dispersed into hydrophilic colloids, which function as a carrier, using various known techniques. Such techniques are specifically described in, for example, U.S. Pat. No. 2,322,027, published examined Japanese Patent Application Nos. 39853/76 and 4932/64, and so on.

The present invention can also be applied to multilayered multicolor photographic materials which have on a support at least two emulsion layers differing in spectral sensitivity. A multilayer color photographic material comprises a support having generally provided thereon at least one red-sensitive emulsion layer, at least one green-sensitive emulsion layer and at least one blue-sensitive emulsion layer. Arrangement order of these emulsion layers may be selected case by case. Various combinations consisting of a combination of a red-sensitive emulsion layer with a cyan dye providing compound, a combination of a green-sensitive emulsion layer with a magenta dye providing compound, and a combination of a blue-sensitive emulsion layer with an yellow dye providing compound, may be used. However, different combinations can be employed if circumstances require.

An interlayer may be provided between each of the light-sensitive layers.

A mordanting layer, a neutralizing layer, a neutralizing speed controlling layer (timing layer), and an isolating layer can be included in the photographic material of the present invention when it is used as a light-sensitive material for a color diffusion transfer process. The layers described in published unexamined Japanese Patent Applications Nos. 64533/77 and 52056/80 have been found to be useful. One preferable photographic material is a mono sheet type of film unit which consists of a light-sensitive element, an image receiving element and a processing element. Such a material maintain a united form throughout the whole photographic process, that is, before, during and after exposure and can be developed in a light room. Such a film unit is described in detail in, for example, *Photographic Science and Engineering,* and *Neblette's Handbook of Photography and Reprography Materials, Process and Systems,* The 7-th Ed., Chapter 12 (1977).

The photographic emulsion layers and other hydrophilic colloidal layers which make up the photographic light-sensitive materials of the present invention can be coated on a support or other constituent layers using various known coating techniques. Suitable coating techniques which can be used include a dip coating technique, a roller coating technique, a curtain coating technique, an extrusion coating technique and so on. In particular, those described in U.S. Pat. Nos. 2,681,294, 2,761,791 and 3,526,528 are advantageously used.

The photographic light-sensitive materials of the present invention can be used for various purposes, such as color positive light-sensitive materials, color paper light-sensitive materials, color negative light-sensitive materials, reversal color light-sensitive materials (with or without couplers), photographic light-sensitive materials suitable for graphic arts (e.g., lithographic films), light-sensitive materials for recording a cathode-ray tube display, light-sensitive materials for X-ray recording (particularly for X-ray photography and photofluorography using a screen), light-sensitive materials for colloid transfer process (e.g., as described in U.S. Pat. No. 2,716,059), light-sensitive materials for the silver salt diffusion transfer process (e.g., as described in U.S. Pat. Nos. 2,352,014, 2,543,181, 3,020,155, 2,861,885 and so on), light-sensitive materials for the color diffusion transfer process (e.g., as described in U.S. Pat. Nos. 3,087,817, 3,185,567, 2,983,606, 3,253,915, 3,227,550, 3,227,551, 3,227,552, 3,415,644, 3,415,645 and 3,415,646; *Research Disclosure,* Vol. 151, No. 15162, pp. 75 to 87 (Nov. 1976); and so on), light-sensitive materials for the dye transfer process (imbibition transfer process) (e.g., as described in U.S. Pat. No. 2,882,156 and so on), light-sensitive materials for the silver dye bleach process (described in Friedman, *History of Color Photography,* Americal Photographic Publisher Co. (1944), particularly Chapter 24, *British Journal of Photography,* Vol. 111, pp. 308 to 309 (April 7, 1964) and so on), direct positive light-sensitive materials (e.g., as described in U.S. Pat. Nos. 2,497,875, 2,588,982, 3,367,778, 3,501,306, 3,501,305, 3,672,900, 3,477,852, 2,717,833, 3,023,102, 3,050,395 and 3,501,307; and so on), heat developable light-sensitive materials (e.g., as described in U.S. Pat. Nos. 3,152,904, 3,312,550 and 3,148,122; British Pat. No. 1,110,046; and so on), light-sensitive materials for physical development (e.g., as described in British Pat. Nos. 920,277 and 1,131,283; and so on) and so on.

The photographic light-sensitive materials of the present invention can, in particularly, be utilized to advantage as multilayered coupler-in-emulsion type color films and more particularly, reversal color and negative color films, white-and-black highly sensitive negative films, films for the color diffusion transfer process, and direct positive light-sensitive materials.

The exposure for obtaining a photographic image may be carried out in a conventional manner. Any various known light sources, which include, e.g., natural light (sun light), a tungsten lamp, a fluorescent lamp, a mercury lamp, a xenon arc lamp, laser light, a carbon arc lamp, a xenon flash lamp, cathode-ray tube flying spot and so on, can be employed for the exposure.

The photographic light-sensitive materials of the present invention are development-processed using various known methods depending on the end-use purposes thereof. Examples of methods for the development processing which can be used include those for the black-and-white development processing, those for the color development processing, those of the lithographic development processing, those for the physical development processing, processing methods for obtaining color diffusion transfer images, the activator process in which a developing agent is incorporated on the light-sensitive material side, processing methods for the silver dye bleach process, and so on. For details of these processing methods descriptions in known literatures, such as *Research Disclosure,* Vol. 176, pp. 28 to 30, Items XIX to XXI; *Photographic Science and Engineering,* Vol. 20, No. 4, pp. 155 to 164 (Aug. 1976); and so on, should be referred to.

The present invention will now be illustrated in greater detail by reference to the following examples.

EXAMPLE 1

To a silver iodobromide gelatin emulsion which contained 6 mole % of silver iodide having a mean silver halide grain size of 0.8μ, were added 5 mg per mole of silver halide of sodium thiosulfate, 3.5 mg per mole of silver halide of potassium chloroaurate and 0.18 g per mole of silver halide of ammonium thiocyanate. The resulting emulsion was ripened at a temperature of 60° C. for 60 minutes.

Polymers of the present invention and comparative compounds set forth in Table 1 were added to separate portions of the thus ripened emulsion in their respective amounts set forth in Table 1 and further, a coating aid (sodium dodecylbenzenesulfonate) and a hardening agent (2,4-dichloro-6-hydroxy-s-triazine) were added thereto.

Each of these emulsions was coated on a cellulose triacetate support, and dried to prepare samples 1 to 15.

One part of each sample was stored for 7 days in a refrigerator the temperature of which was controlled to 5° C., another part was allowed to stand for 7 days in the atmosphere kept at a temperature of 50° C. and a relative humidity of 20%, and the other part was allowed to stand for 7 days in the atmosphere kept at a temperature of 50° C. and a relative humidity of 80%. Thereafter, these three parts of each sample were exposed through an optical wedge using a sensitometer (for a period of 1/20 second), developed with the Kodak D-72 developing solution at 20° C. for 4 minutes, fixed in a conventional manner, washed with water, and dried. Photographic characteristics (sensitivity and fog density) of the thus processed samples were examined to obtain the results described in Table 1.

In addition, each of the coated samples was soaked in a buffer solution adjusted to pH=10.0 at a temperature of 25° C. for 4 minutes, and amounts of the polymers or the comparative compounds eluted from their respective samples into the buffer solution were measured using the UV absorption process, respectively. These results (elution rate) are also described in Table 1.

The standard point of optical density to determine photographic sensitivity was fog+0.20. The results of sensitivity measurements shown in Table 1 are relative values of the sample −1 as 100.

As is apparent from the results shown in Table 1, the polymers of the present invention were found to exhibit a fog inhibiting effect (stabilizing effect) equivalent to or higher than that of the comparative compound A or B. Furthermore, in this example the added amount of polymers of the present invention was determined in order that the amount of 1,2,4-triazolo[1,5-a]pyrimidines contained in the polymers was almost the same as the amount of the comparative compound A or B. Therefore, it can be seen that the polymers of the present invention have very good stabilizing effect. From the results of the comparative samples 6 and 7, it can be also seen that the comparative compound C or D which did not contain the 1,2,4-triazolo[1,5-a]pyrimidines had no stabilizing effect even if the main chain structure of the comparative compounds was the same as that of the polymers of the present invention. Further, it can be seen that the polymers of the present invention hardly had a harmful influence on controlling the developing speed, even if large amounts of photographic light-sensitive materials were processed in certain processing solutions, because the polymers of the present invention are hardly dissolved into the processing solutions as compared with the comparative compound A or B.

-continued

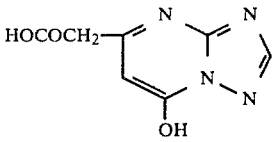

TABLE 1

| No. | Compound Added (Stabilizer) | Amount Added (g/mole AgX) | Relative Sensitivity: Inside Refrigerator | Relative Sensitivity: 50° C., 20% RH 7 Days | Relative Sensitivity: 50° C., 80% RH 7 Days | Fog: Inside Refrigerator | Fog: 50° C., 20% RH 7 Days | Fog: 50° C., 80% RH 7 Days | Elution Rate (%) |
|---|---|---|---|---|---|---|---|---|---|
| 1 | Not Added (Control) | — | 100 | 138 | 68 | 0.06 | 0.14 | 0.12 | — |
| 2 | Comparative Compound A | 0.34 | 100 | 138 | 68 | 0.05 | 0.08 | 0.10 | — |
| 3 | | 4.08 | 105 | 126 | 80 | 0.04 | 0.05 | 0.05 | 86 |
| 4 | Comparative Compound B | 0.43 | 100 | 135 | 68 | 0.06 | 0.15 | 0.11 | — |
| 5 | | 5.21 | 96 | 138 | 80 | 0.05 | 0.08 | 0.07 | 88 |
| 6 | Comparative Compound C | 19.28 | 100 | 100 | 59 | 0.06 | 0.18 | 0.14 | — |
| 7 | Comparative Compound D | 12.03 | 76 | 135 | 62 | 0.10 | 0.12 | 0.14 | — |
| 8 | Polymer 1-2 | 2.10 | 100 | 138 | 76 | 0.05 | 0.06 | 0.10 | — |
| 9 | | 25.20 | 100 | 126 | 85 | 0.04 | 0.04 | 0.04 | 25 |
| 10 | Polymer 2-1 | 3.71 | 100 | 138 | 89 | 0.06 | 0.08 | 0.12 | — |
| 11 | | 44.52 | 105 | 138 | 80 | 0.04 | 0.04 | 0.04 | 40 |
| 12 | Polymer 9-5 | 2.95 | 85 | 112 | 72 | 0.06 | 0.06 | 0.12 | — |
| 13 | | 35.40 | 89 | 100 | 78 | 0.04 | 0.04 | 0.08 | 38 |
| 14 | Polymer 7-2 | 1.04 | 100 | 138 | 68 | 0.05 | 0.08 | 0.09 | — |
| 15 | | 12.48 | 91 | 100 | 72 | 0.04 | 0.05 | 0.05 | 30 |

Comparative Compound A

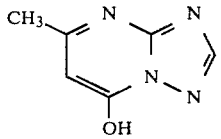

Comparative Compound B

Comparative Compound C

Polyacrylamide

Comparative Compound D

Polyvinyl Pyrrolidone

EXAMPLE 2

On a paper support both sides of which are laminated with polyethylene, were coated the layers, from the first layer (lowest layer) to the sixth layer (topmost layer), described in Table 2 to prepare a multilayer color photographic light-sensitive material. (In Table 2, the amount coated is expressed in mg/m$^2$:)

TABLE 2

| | | |
|---|---|---|
| The Sixth Layer (Protective Layer) | Gelatin | 1500 mg/m$^2$ |
| The Fifth Layer (Red-Sensitive Layer) | Silver chlorobromide emulsion (silver bromide 50 mol %, silver | 250 mg/m$^2$) |
| | Gelatin | 1500 mg/m$^2$ |
| | Cyan coupler*1 | 500 mg/m$^2$ |
| | Coupler solvent*2 | 250 mg/m$^2$ |
| The Fourth Layer (Ultra Violet Absorbing Layer) | Gelatin | 1200 mg/m$^2$ |
| | Ultra violet absorbent*3 | 700 mg/m$^2$ |
| | Ultra violet absorbent solvent*2 | 250 mg/m$^2$ |
| The Third Layer (Green-Sensitive Layer) | Silver chlorobromide emulsion (silver bromide 70 mol %, silver | 350 mg/m$^2$) |
| | Gelatin | 1500 mg/m$^2$ |
| | Magenta coupler*4 | 400 mg/m$^2$ |
| | Coupler solvent*5 | 400 mg/m$^2$ |
| The Second Layer (Interlayer) | Gelatin | 1000 mg/m$^2$ |
| The First Layer (Blue-Sensitive Layer) | Silver chlorobromide emulsion (silver bromide 80 mol %, silver | 350 mg/m$^2$) |
| | Gelatin | 1500 mg/m$^2$ |
| | Yellow coupler*6 | 500 mg/m$^2$ |
| | Coupler solvent*2 | 250 mg/m$^2$ |

TABLE 2-continued

| Support | Polyethylene-laminated paper |
|---|---|

*[1]Cyan Coupler: 2-[α-(2,4-di-t-amylphenoxy)butaneamido]-4,6-dichloro-5-methylphenol.
*[2]Coupler Solvent: Trinonyl Phosphate
*[3]Ultraviolet Absorbent: 2-(2-hydroxy-3-sec-butyl-5-t-butylphenyl)benzotriazole
*[4]Magenta Coupler: 1-(2,4,6-trichlorophenyl)-3-[2-chloro-5-tetradecaneamido]anilino-2-pyrazolino-5-one
*[5]Coupler Solvent: o-Cresyl Phosphate
*[6]Yellow Coupler: α-pivaloyl-α-[2,4-dioxo-5,5'-dimethyloxazolidine-3-yl]-2-chloro-5-[α-(2,4-di-t-amylphenoxy)butaneamido]acetoanilide A sample (No. 16) was prepared in the same manner as described above except that the red-sensitive spectral sensitizing dye having the following structural formula was added to the fifth layer:

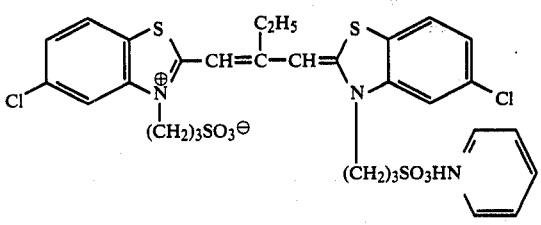

Another sample (No. 17) was prepared in the same manner as in the sample No. 16 except that the comparative compound A was added to the first layer in an amount of 2.0 mg/m$^2$. Further, other samples, Nos. 18, 19, 20 and 21, were prepared in the same manner as in the sample 16 except that the polymers of the present invention shown in Table 3 were added to the first layer, respectively. All of the thus coated samples were stored in the dark room for 2 weeks under the condition of 40° C. and 80% RH. Thereafter, each sample was subjected to exposure under a conventional known condition and subsequently, to development processings described hereinafter. Blue-sensitivity and red-sensitivity of the thus processed samples each were measured. The results obtained are shown in Table 3. (Therein, the standard point of optical density to determine photographic sensitivity was fog+0.20. Sensitivities shown in Table 3 are relative values of the sample No. 16 as 100.)

| Sample No. | Stabilizing Agent | Amount Added Addition Ratio by Mole* | First Layer (Blue-sensitive Layer) Relative Sensitivity | Fog | Fifth Layer (Red-sensitive Layer) Relative Sensitivity | Fog |
|---|---|---|---|---|---|---|
| 16 | Not added (Control) | — | 100 | 0.35 | 100 | 0.14 |
| 17 | Comparative Compound A | 1 | 46 | 0.05 | 62 | 0.12 |
| 18 | Polymer 9-1 | 2/1000 | 82 | 0.10 | 96 | 0.14 |
| 19 | Polymer 7-2 | 1/100 | 65 | 0.07 | 93 | 0.14 |
| 20 | Polymer 1-3 | 1 | 72 | 0.07 | 91 | 0.13 |
| 21 | Polymer 1-1 | 1 | 82 | 0.05 | 100 | 0.14 |

*Value obtained by dividing the number of moles of 1,2,4-triazolo[1,5-a]pyrimidine moiety contained in the added amount of each stabilizing agent by the number of moles of the comparative compound A added to the sample No. 17.

Compound A inhibits lowering of sensitivity and increases the amount of fog in the blue-sensitive layer after two weeks' of storage at 40° C. and 80% RH, that is, it improves storability. However, it lowers the sensitivity of the red-sensitive layer due to its diffusibility. On the other hand, the polymers of the present invention not only could inhibit an increase of the amount of fog in the blue-sensitive layer due to incubation to the level equivalent to that of the compound A, but also could inhibit an deterioration of sensitivity due to incubation more effectively than that of the compound A. Furthermore, the polymers of the present invention hardly had a harmful influence on sensitivity of red-sensitive layer. This is ascribable to non-diffusibility of the polymers of the present invention into other constituent layers. Therefore, it is possible to stabilize a specified layer alone among constituent layers of the photographic light-sensitive materials using the polymers of the present invention.

EXAMPLE 3

Sample Nos. 22, 23 and 24 were prepared so as to have the same constitution as that of the sample No. 16 except that the polymers of the present invention shown in Table 4 were added to the third layer in an amount of $5\times10^{-7}$ mole/m$^2$, respectively. For comparison of the samples containing the polymers with the sample not containing any stabilizing agent, one part of each sample was allowed to stand at a room temperature for 2 days after the exposure processing and then, subjected to the development processing. The other part was subjected to the development processing just after the exposure processing. The difference in optical density attained with the same amount of exposure, which corresponded to the amount used for obtaining the optical density D=1.0 in the latter case, between the former case and the latter case was examined in each of samples.

TABLE 4

| Sample No. | Compound Added | Density Difference |
|---|---|---|
| 16 | — | −0.20 |
| 22 | Polymer 9-4 | −0.05 |
| 23 | Polymer 9-5 | −0.03 |
| 24 | Polymer 8-2 | −0.08 |

As can be seen from Table 4, the polymers of the present invention improve the stability of the latent image after exposure.

Conditions for the development processing employed in both Examples 2 and 3 were described below.

| Processing | Time | Temperature |
|---|---|---|
| Color Development | 3'30" | 33° C. |
| Bleaching Fixation | 1'30" | 33° C. |
| Washing | 2'00" | 33° C. |
| Drying | | |

| Composition of Color Developing solution | |
|---|---|
| Benzyl Alcohol | 15 ml |
| Sodium Sulfite | 5 g |
| Potassium Bromide | 0.5 g |
| Hydroxyamine Sulfate | 2.0 g |
| Sodium Carbonate | 30.0 g |
| Sodium Nitrilotriacetate | 2.0 g |
| 4-Amino-3-methyl-N—(β-methanesulfonamido)-ethyl-aniline | 5.0 g |
| Water to make | 1000 ml |
| pH adjusted to | 10.1 |
| **Composition of Bleaching-Fixing Solution** | |
| Ammonium Thiosulfate | 105 g |
| Sodium Sulfite | 2 g |
| Disodium Ethylenediaminetetraacetate | 40 g |
| Sodium Carbonate ($H_2O$) | 5 g |
| Water to make | 1000 ml |
| pH adjusted to | 7.0 |

EXAMPLE 4

On a transparent polyethylene terephthalate film support, were coated the layers described below to prepare a light-sensitive sheet A.

Light-sensitive Sheet A (1) Image receiving layer containing 3.0 g/m² of copoly[styrene-N-vinylbenzyl-N,N,N-trihexylammonium chloride] and 3.0 g/m² of gelatin.

(2) White reflecting layer containing 20 g/m² of titanium dioxide and 2.0 g/m² of gelatin.

(3) Opaque layer containing 2.0 g/m² of carbon black and 1.5 g/m² of gelatin.

(4) Layer containing 0.44 g/m² of the cyan dye releasing redox compound having the following structural formula, 0.09 g/m² of tricyclohexyl phosphate, 0.008 g/m² of 2,5-di-t-pentadecylhydroquinone and 0.8 g/m² of gelatin.

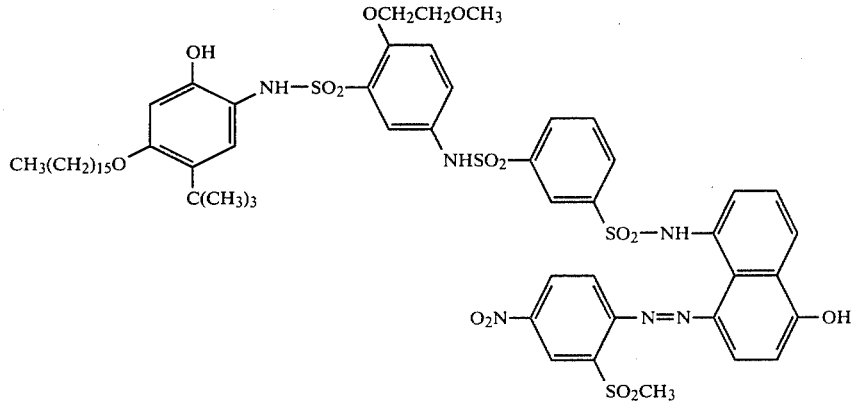

(5) Layer containing a red-sensitive internal latent image type direct positive silver bromide emulsion (containing 1.03 g/m² of silver), 1.2 g/m² of gelatin, 0.04 mg/m² of the nucleating agent having the following structural formula and 0.13 g/m² of sodium salt of 2-sulfo-5-n-pentadecylhydroquinone.

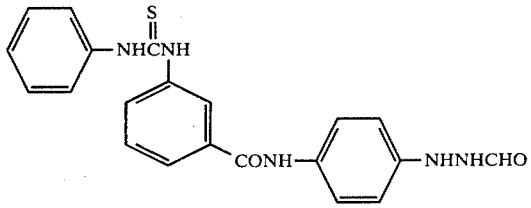

(6) Layer containing 0.43 g/m² of 2,5-di-t-pentadecylhydroquinone, 0.1 g/m² of trihexyl phosphate and 0.4 g/m² of gelatin.

(7) Layer containing the magenta dye releasing redox compound having the following structural formula I (0.21 g/m²), the other magenta dye releasing redox compound having the following structural formula II (0.11 g/m²), tricyclohexyl phosphate (0.08 g/m²), 2,5-di-t-pentadecylhydroquinone (0.009 g/m²) and gelatin (0.9 g/m²).

Formula I

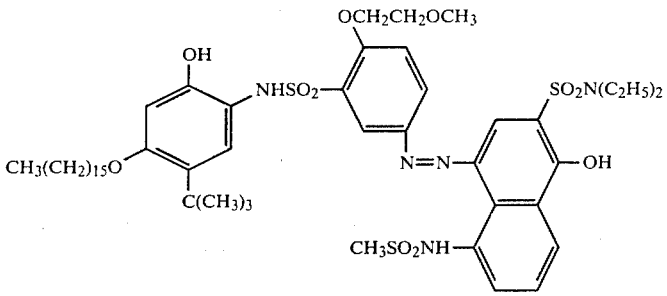

-continued

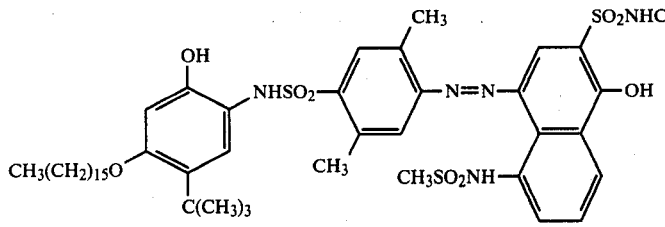

(8) Layer containing a green-sensitive internal latent image type direct positive silver bromide emulsion (containing 0.82 g/m$^2$ of silver), gelatin (0.9 g/m$^2$), the same nucleating agent as in the layer (5) (0.03 mg/m$^2$) and sodium salt of 2-sulfo-5-n-pentadecylhydroquinone (0.08 g/m$^2$).

(9) Layer having the same composition as in the layer (6).

(10) Layer containing the yellow dye releasing redox compound of the following structural formula (0.53 g/m$^2$), tricyclohexyl phosphate (0.13 g/m$^2$), 2,5-di-t-pentadecylhydroquinone (0.014 g/m$^2$) and gelatin (0.7 g/m$^2$).

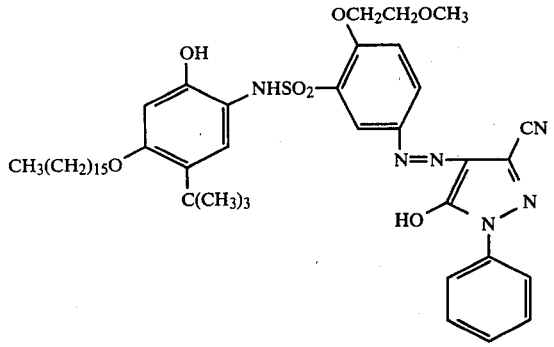

(11) Layer containing a blue-sensitive internal latent image type direct positive silver bromide emulsion (containing 1.09 g/m$^2$ of silver), gelatin (1.1 g/m$^2$), the same nucleating agent as in the layer (5) (0.04 mg/m$^2$) and sodium salt of 2-sulfo-5-n-pentadecylhydroquinone (0.07 g/m$^2$).

(12) Layer containing the same ultraviolet absorbent I as in Example 2 (0.3 g/m$^2$), the other ultraviolet absorbent II (0.3 g/m$^2$), gelatin (0.6 g/m$^2$), tris(2-ethylhexyl)phosphate, polymethylmethacrylate latex (0.02 g/m$^2$) and triacryloyltriazine as a hardening agent (0.02 g/m$^2$).

Light-sensitive Sheet B

A light-sensitive sheet B was prepared so as to have the same constitution as that of the light-sensitive sheet A except that the polymer 1-1 of the present invention was added to the layer (5), to the layer (8) and to the layer (11) in amounts described below, respectively.

The Layer (5)—182 mg/m$^2$
The Layer (8)—89 mg/m$^2$
The Layer (11)—52 mg/m$^2$

On a transparent polyethylene terephthalate film support, were coated the layers described below in this order to prepare a cover sheet.

Cover Sheet (1') Layer containing 22 g/m$^2$ of acrylic acid-butylacrylate (80:20 by weight) copolymer and 0.44 g/m$^2$ of 1,4-bis(2,3-epoxypropoxy)butane.

(2') Layer containing 3.8 g/m$^2$ of acetyl cellulose (which corresponded to that producing 39.4 g of acetyl group when 100 g thereof was hydrolyzed), 0.23 g/m$^2$ of a methanol ring-opening product of styrene-maleic anhydride (60:40 by weight) copolymer (having a molecular weight of about fifty thousands) and 0.154 g/m$^2$ of 5-(2-cyano-1-methylthio)-1-phenyltetrazole.

(3') Layer having a thickness of 2$\mu$ prepared by coating a mixture which was obtained by mixing styrene-n-butylacrylate-acrylic acid-N-methylolacrylamide (49.7:42.3:4:4 by weight) copolymer latex with methylmethacrylate-acrylic acid-N-methylolacrylamide (93:3:4 by weight) copolymer latex so that the mixing ratio might be 6:4, converted to a basis of solid content.

Composition of Processing Solution 1-p-Tollyl-4-hydroxymethyl-4-methyl-3-pyrazolidone—6.9 g
Methylhydroquinone—0.3 g
5-Methylbenzotriazole—3.5 g
Sodium Sulfite (Anhydrous)—0.2 g
Sodium Salt of Carboxymethyl Cellulose—58 g
Potassium hydroxide (28% Aqueous Solution)—200 ml
Benzyl Alcohol—1.5 ml
Carbon Black—150 g
Water—685 ml 0.8 g portions of the processing solution having the above-described composition were charged into separate "pressure rupturable" containers.

Processing Steps

The above-described light-sensitive sheets A and B were each brought into face-to-face contact with the above-described cover sheet. They were exposed to light through a color test chart from the cover sheet side. The processing solution was then spread in a layer having a thickness of 75$\mu$ between these two sheets (by means of pressure applying rollers). The processing was carried out at a temperature of 25° C. After passage of one hour from the conclusion of the processing, the blue density, green density and red density of the images produced in the image receiving layer, respectively, were measured from the transparent support side of the light-sensitive sheet using a Macbeth reflection densitometer. The results obtained are shown in Table 5.

It is apparent from Table 5 that the compounds of the present invention act effectively as a stabilizing agent.

TABLE 5

| | Storage Condition | Blue-Sensitive Layer | | Green-Sensitive Layer | | Red-Sensitive Layer | |
|---|---|---|---|---|---|---|---|
| | | $D_{max}$ | $D_{min}$ | $D_{max}$ | $D_{min}$ | $D_{max}$ | $D_{min}$ |
| Light-Sensitive Sheet A | Without Forced Aging | 1.94 | 0.22 | 2.32 | 0.20 | 2.20 | 0.32 |
| | 60° C., 10% RH, 3 days | 1.72 | 0.34 | 1.76 | 0.24 | 1.08 | 0.36 |
| | 45° C., 80% RH, 3 days | 0.93 | 0.24 | 1.92 | 0.23 | 1.80 | 0.36 |
| Light-Sensitive Sheet B | Without Forced Aging | 1.94 | 0.22 | 2.17 | 0.20 | 2.32 | 0.32 |
| | 60° C., 10% RH, 3 days | 1.75 | 0.24 | 1.78 | 0.20 | 2.25 | 0.32 |
| | 45° C., 80% RH, 3 days | 1.70 | 0.23 | 2.01 | 0.20 | 2.18 | 0.32 |

EXAMPLE 5

On a transparent polyethylene terephthalate support, were coated the layers described below to prepare a light-sensitive sheet.

Light-sensitive Sheet C

The layers (1) to (4) and the layers (6) to (12) were the same as those of the light-sensitive sheet A, respectively, and the layer (5) further contained 4.2 mg/m$^2$ of 4-hydroxy-6-methyl-1,3,3a,7-tetrazaindene in addition to the same constituents that the layer (5) of the light-sensitive sheet A had.

Light-sensitive Sheet D the layers (1) to (4) and the layers (6) to (12) were the same as those of the light-sensitive sheet A, respectively, and the layer (5) further contained 182 mg/m$^2$ of the polymer 1-1 in addition to the same constituents that the layer (5) of the light-sensitive sheet A had.

These light-sensitive sheets A, C and D were each brought into face-to-face contact with the above-described cover sheet, and subjected to the same processings as in Example 4. The image densities measured are shown in Table 6.

As is apparent from the results of Table 6, 4-hydroxy-6-methyl-1,3,3a,7-tetrazindene added only to the layer (5) (red-sensitive layer) of the light-sensitive sheet C moves across the intermediate layers into the layer (11) (blue-sensitive layer), also stabilizing the blue-sensitive layer. On the other hand, the polymer of the present invention added only the layer (5) of the light-sensitive sheet D migrates to other layers to a reduced extent, and does not appreciably stabilize other layers. Therefore, its stabilizing effect upon the red-sensitive layer becomes substantially larger.

That is, the compound of the present invention acts as a good stabilizer and acts selectively on the layer to which it is added.

EXAMPLE 6

On a transparent polyethylene terephthalate film support, were coated the layers described below to prepare a light-sensitive sheet.

Light-sensitive Sheets E and F

They each had the same layers (1) to (4), the same layers (6) and (7), the same layer (9) and the same layers (10) to (12) as those of the light-sensitive sheet A, respectively. The layers (5), (8) and (11) are described below.

(5) A red-sensitive emulsion layer containing a red-sensitive internal latent image type direct positive silver bromide emulsion (containing 1.03 g/m$^2$ of silver), 1.2 g/m$^2$ of gelatin, 0.04 mg/m$^2$ of the nucleating agent of the following structural formula, a stabilizing agent shown in Table 7 and 0.13 g/m$^2$ of sodium salt of 2-sulfo-5-n-pentadecylhydroquinone.

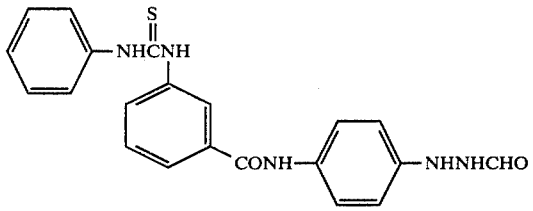

(8) A green-sensitive emulsion layer containing a green-sensitive internal latent image type direct positive silver bromide emulsion (containing 0.82 g/m$^2$ of silver) color sensitized with the sensitizing dye X having the following structural formula (0.8 mg/m$^2$) and the sensitizing dye Y having the following structural formula (1.1 mg/m$^2$), gelatin (0.9 g/m$^2$), the same nucleating agent as used in the layer (5) (0.03 mg/m$^2$), the stabilizing agent shown in Table 7 and 0.08 g/m$^2$ of sodium salt of 2-sulfo-5-n-pentadecylhydroquinone.

Sensitizing Dye X

TABLE 6

| | Storage Condition | Blue-Sensitive Layer | | Green-Sensitive Layer | | Red-Sensitive Layer | |
|---|---|---|---|---|---|---|---|
| | | $D_{max}$ | $D_{min}$ | $D_{max}$ | $D_{min}$ | $D_{max}$ | $D_{min}$ |
| Light-Sensitive Sheet A | Without Forced Aging | 1.94 | 0.22 | 2.32 | 0.20 | 2.20 | 0.32 |
| | 60° C., 10% RH, 3 days | 1.72 | 0.34 | 1.76 | 0.24 | 1.08 | 0.36 |
| | 45° C., 80% RH, 3 days | 0.93 | 0.24 | 1.92 | 0.23 | 1.80 | 0.36 |
| Light-Sensitive Sheet C | Without Forced Aging | 2.00 | 0.22 | 2.34 | 0.20 | 2.20 | 0.32 |
| | 60°C., 10% RH, 3 days | 1.80 | 0.30 | 2.06 | 0.23 | 1.55 | 0.35 |
| | 45° C., RH, 3 days | 1.55 | 0.24 | 1.30 | 0.22 | 1.80 | 0.35 |
| Light-Sensitive Sheet D | Without Forced Aging | 1.83 | 0.22 | 2.40 | 0.20 | 2.40 | 0.32 |
| | 60° C., 10% RH, 3 days | 1.76 | 0.33 | 2.20 | 0.23 | 2.20 | 0.32 |
| | 45° C., 80% RH, 3 days | 1.48 | 0.24 | 2.10 | 0.22 | 2.25 | 0.33 |

-continued

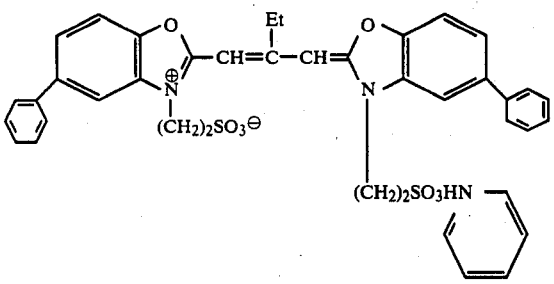

Sensitizing Dye Y

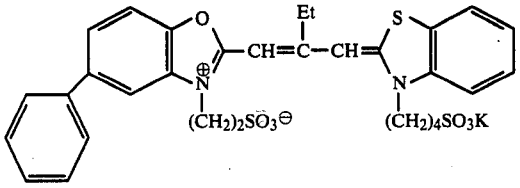

(12) A blue-sensitive emulsion layer containing a blue-sensitive internal latent image type direct positive silver bromide emulsion (containing 1.09 g/m$^2$ of silver), gelatin (1.1 g/m$^2$), the same nucleating agent as used in the layer (5) (0.04 mg/m$^2$), the stabilizer shown in Table 7 and 2-sulfo-5-n-pentadecylhydroquinone sodium salt (0.07 g/m$^2$).

TABLE 7

| | Stabilizing Agent | | | Amount Added |
|---|---|---|---|---|
| Light-sensitive Sheet E | 4-Hydroxy-6-methyl-1,3,3a,7-tetra indene | (5) | Red-sensitive Emulsion Layer | 4.2 (mg/m$^2$) |
| | | (8) | Green-sensitive Emulsion Layer | 2.1 (mg/m$^2$) |
| | | (11) | Blue-sensitive Emulsion Layer | 1.1 (mg/m$^2$) |
| Light-sensitive Sheet F | Polymer 1-1 | (5) | Red-sensitive Emulsion Layer | 182 (mg/m$^2$) |
| | | (8) | Green-sensitive Emulsion Layer | 89 (mg/m$^2$) |
| | | (11) | Blue-sensitive Emulsion Layer | 52 (mg/m$^2$) |

The above-described light-sensitive sheets E, F and A respectively were brought into face-to-face contact with the cover sheets prepared in Example 4, and subjected to the same processings as carried out in Example 4. The results of sensitivity measurement are shown in Table 8. In addition, spectrograms of the green-sensitive emulsion layers of these light-sensitive materials of E and F are shown in FIG. 1.

TABLE 8

| | $S^{\frac{1}{2}}_{rel}$ |
|---|---|
| Light-sensitive sheet E | 100 |
| Light-sensitive sheet F | 170 |
| Light-sensitive sheet A | 180 |

$S^{\frac{1}{2}}_{rel}$: Relative value of photographic sensitivity at the density of $(D_{max} + D_{min})/2$ to green light.

As is apparent from Table 8 and FIG. 1, the light-sensitive material prepared with the polymer of the present invention is added has higher sensitivity than the light-sensitive material prepared with 4-hydroxy-6-methyl-1,3,3a,7-tetrazindene. It can therefore be presumed that 4-hydroxy-6-methyl-1,3,3a,7-tetrazaindene inhibits emulsion grains from being adsorbed by sensitizing dye molecules. Accordingly, the color sensitization sensitivity is lowered. The polymer of the present invention does not apprecially inhibit adsorption of sensitizing dye molecules onto emulsion grains. However, it has an excellent effect upon stabilization of the emulsions. Therefore, by using the present invention high color sensitization sensitivity can be obtained.

As is apparent from the results shown in the above Tables, the polymerized stabilizers used for the photographic light-sensitive materials of the present invention have very good stabilizing effect, can effectively stabilize a specified layer alone, because they hardly diffuse into other constituent layers, can stabilize the photographic light-sensitive materials without decreasing the sensitivity thereof because they do not inhibit dye sensitization, and simplify the control of development in case of treating large amounts of photographic light-sensitive materials, because they are hardly dissolved into the processing solutions.

While the invention has been described in detail and with reference to specific embodiment thereof, it will be apparent to one skilled in the art that various changes and modifications can be made therein without departing from the spirit and scope thereof.

What is claimed is:

1. A silver halide photographic light-sensitive material, comprising:

a support base;

a silver halide emulsion layer; and a polymer containing repeating units having a 1,2,4-triazolo[1,5-a]pyrimidine moiety, the polymer having a molecular weight in the range of $5\times10^3$ to $3\times10^6$.

2. A silver halide photographic light-sensitive material as claimed in claim 1, wherein the molecular weight of the polymer is in the range of $1\times10^4$ to $1\times10^6$.

3. A silver halide photographic light-sensitive material as claimed in any of claims 1 or 2, wherein the repeating units of the polymer are represented by the general formula:

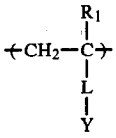

wherein $R^1$ is hydrogen or a lower alkyl group; L is a divalent bonding group; and Y is a monovalent 1,2,4-triazolo[1,5-a]pyrimidine moiety.

4. A silver halide photographic light-sensitive material as claimed in claim 3, wherein the 1,2,4-triazolo[1,5-a]pyrimidine moiety is selected from a group consisting of those having the following general formulae (X-I), (X-II) and (X-III).

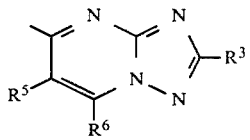
(X-I)

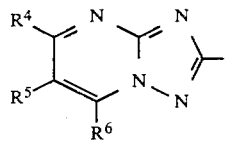
(X-II)

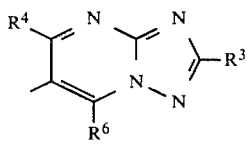
(X-III)

wherein $R^3$, $R^4$, $R^5$ and $R^6$ may be the same or different and each represents hydrogen, an unsubstituted or substituted alkyl group, an unsubstituted or substituted aryl group, a substituted amino group, an unsubstituted or substituted carbamoyl group, a hydroxy group, an —OM group (wherein M represents an alkali metal ion or an ammonium ion), a cyano group, a halogen atom, an alkoxy group, an alkoxycarbonyl group, and an alkylthio group, or $R^4$ and $R^5$ may combine with each other and form a ring.

5. A silver halide photographic light-sensitive material as claimed in claim 3, wherein L is selected from a group consisting of those having the following general formulae (L-I) and (L-II):

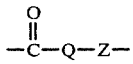
(L-I)

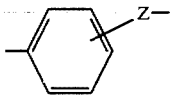
(L-II)

wherein Q represents —O— or

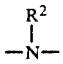

wherein $R^2$ represents hydrogen or a lower alkyl group), and Z represents an alkylene group.

6. A silver halide photographic light-sensitive material as claimed in claim 4, wherein the 1,2,4-triazolo[1,5-a]pyrimidine moiety is selected from a group consisting of

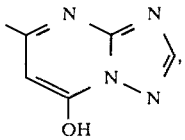

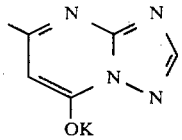

-continued

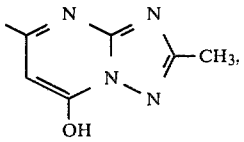

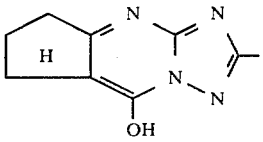

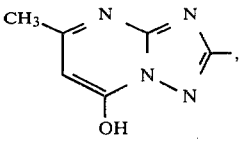

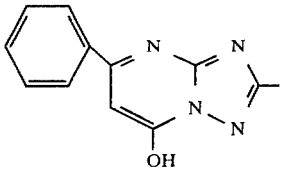

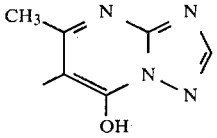

7. A silver halide photographic light-sensitive material as claimed in claim 5, wherein L is selected from a group consisting of —$CONHCH_2$—, —$CONHCH_2CH_2$—, —$CONHCH_2OCOCH_2$—, —$CONHCH_2CH_2CH_2OCOCH_2$—, —$COOCH_2$—, —$COOCH_2CH_2$—, —$COOCH_2CH_2OCOCH_2$—, —$COOCH_2CH_2CH_2OCOCH_2$—, and

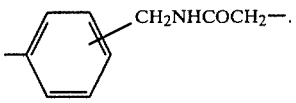

8. A silver halide photographic light-sensitive material as claimed in claim 3, wherein the polymer is present in an amount of $10^{-8}$ to $10^{-3}$ moles per 1 $m^2$ of the support.

9. A silver halide photographic light-sensitive material as claimed in claim 8, wherein the polymer is present in an amount of $10^{-7}$ to $5\times10^{-4}$ moles per 1 $m^2$ of the support.

10. A silver halide photographic light-sensitive material as claimed in claim 3, wherein the polymer is present in an amount of 0.02 mg to about 2 g per 1 $m^2$ of the support.

11. A silver halide photographic light-sensitive material as claimed in claim 10, wherein the polymer is present in an amount of 0.2 mg to about 1 g per 1 $m^2$ of the support.

12. A silver halide photographic light-sensitive material as claimed in claim 3, wherein the polymer is present in an amount of about 60 mg to about 200 g per 1 mole of silver halide.

13. A silver halide photographic light-sensitive material as claimed in claim 12, wherein the polymer is present in an amount of about 300 mg to about 100 g per 1 mole of silver halide.

14. A silver halide photographic light-sensitive material as claimed in claim 1, wherein the polymers are homopolymers of unsaturated monomers represented by the following general formula

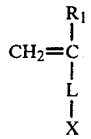

wherein $R^1$ represents hydrogen or a lower alkyl group, L represents a divalent bonding group, and X represents a monovalent 1,2,4-triazolo[1,5-a]pyrimidine moiety.

15. A silver halide photographic light-sensitive material as claimed in claim 1, wherein the polymers are copolymers of unsaturated monomers represented by the following formula

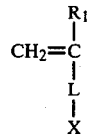

wherein $R^1$ represents hydrogen or a lower alkyl group, L represents a divalent bonding group, and X represents a monovalent 1,2,4-triazolo[1,5-a]pyrimidine moiety, and one or more of ethylenically unsaturated copolymerizable monomers, the former unsaturated monomers being present in an amount of at least 0.1 mol% based on the total amount of those monomers.

16. A silver halide photographic light-sensitive material as claimed in claim 1, said silver halide photographic light-sensitive material further comprises 1,2,4-triazolo[1,5-a]pyrimidine.

* * * * *